US005590448A

United States Patent [19]

Lenzen et al.

[11] Patent Number: 5,590,448

[45] Date of Patent: Jan. 7, 1997

[54] ARRANGEMENT FOR PRODUCING SHORT WARPS WITH ORBITING THREAD LAYING DEVICE

[75] Inventors: Josef Lenzen, Dulmen; Herbert Wisniewski, Coesfeld-Letts, both of Germany

[73] Assignee: Karl Mayer Textilmaschinenfabrik GmbH, Obertshausen, Germany

[21] Appl. No.: 492,324

[22] Filed: Jun. 20, 1995

[30] Foreign Application Priority Data

Jun. 24, 1994 [DE] Germany ..... 44 22 098.7

[51] Int. Cl.[6] ..... D02H 9/02

[52] U.S. Cl. ..... 28/191; 28/195

[58] Field of Search ..... 28/191, 195; 242/47.04, 242/47.01; 139/452

[56] References Cited

U.S. PATENT DOCUMENTS

| | | | |
|---|---|---|---|
| 3,884,429 | 5/1975 | Dow | 28/195 |
| 4,683,625 | 8/1987 | Baltzer | 28/191 |
| 4,765,041 | 8/1988 | Baltzer | 28/191 |
| 4,831,695 | 5/1989 | Baltzer | 28/191 |
| 4,893,386 | 1/1990 | Thier et al. | 28/191 |
| 5,022,128 | 6/1991 | Beerli et al. | 28/191 |

*Primary Examiner*—Andy Falik
*Attorney, Agent, or Firm*—Omri M. Behr, Esq.

[57] ABSTRACT

An arrangement can produce short warps, in particular for woven patterns in which threads (1) of different colors are wound onto a winding arrangement in single layers next to each other and sequentially with respect to each other. The arrangement has positioned at one end face (8) of the winding arrangement a thread laying device (4), which rotates around the circumferential contour of the winding arrangement (2). At least one thread (1) is pulled from a spool (14) in a spool magazine (12) and laid off onto a feed arrangement (16) located on the circumference of the winding arrangement (2) in a winding plane. This feed arrangement transports the wound up thread sheet perpendicular to the winding plane by an amount corresponding to the wind growth. The thread sheet, obtained as an endless sheet band in the direction transverse to the winding direction, can be cut open after completion of the thread warp. The spools (14) of the spool magazine (12) are located one behind the other on an axis running orthogonal to the winding plane.

13 Claims, 3 Drawing Sheets

ARRANGEMENT FOR PRODUCING SHORT WARPS WITH ORBITING THREAD LAYING DEVICE

FIELD OF THE INVENTION

The present invention concerns an arrangement and a process for the production of short warps, in particular for weaving patterns in the field of colored weaving.

DESCRIPTION OF RELATED ART

Short warps are used, for example, for woven patterns, wherein threads of different colors are wound in single layers onto a winding arrangement next to each other and sequentially with respect to each other. A thread laying means adjacent to one end face of the winding arrangement, can orbit around the circumferential contour of the winding arrangement. At least one thread is pulled from a spool in a spool magazine and laid off in a winding plane onto a feed arrangement located on the circumference of the winding arrangement. This feed arrangement transports the wound up thread sheet perpendicular to the winding plane by an amount corresponding to the wind growth. The thread sheet obtained as an endless sheet band in the direction transverse to the winding direction can be cut open after completion of the thread warp.

In such an arrangement, threads of different colors are wound up in sequence and in a single layer next to each other, wherein a thread laying device is movable around the circumferential contour of the windup arrangement. The thread sheet obtained as an endless thread sheet band is openable in the transverse direction.

Arrangements, suitably short warp shearing machines of this type are already known (GB P 1 420 475). By the use of such equipment, short warps can be warped with only one spool for each color. It also thus possible to provide thread sheets with changing colors of thread over a predetermined width of the entire thread sheet for the production of woven patterns. This is carried out in the following manner. The winding surface of a winding arrangement on a carrier is displaceable in a direction transverse to the winding direction and the thread guide is movable around the circumferential contour of the winding arrangement orthogonal to the direction of motion of the moving arrangement of the winding surface, while the carrier of the winding arrangement remains stationary. The wind-up arrangement can be provided as a drum with circumferential portions displaceable in a radial direction, that is to say, out of a minimum of two turning rollers provided at a separation from each other, whose mutual separation is alterable. The feed elements herein comprise feed bands running in the direction of the axis around the outer surface of rollers attached to the drum.

The known short warp shearing machine comprises a spool magazine with radially provided spools. This spooling magazine does not permit an even winding of a plurality of individual threads.

The purpose of the invention therefore is to provide a short warp shearing machine of the prior art type which, in a simple manner, permits the simultaneous winding of a plurality of individual threads.

SUMMARY OF THE INVENTION

In accordance with the illustrative embodiments demonstrating features and advantages of the present invention, there is provided an arrangement for producing short warps for woven patterns employing threads of different colors. The arrangement has a winding arrangement adapted to receive the threads of different colors, wound sequentially next to each other in a single layer. Also included is a thread laying means mounted adjacent to an end face of the winding arrangement for orbiting the winding arrangement circumferentially at the end face for laying the threads in the single layer around the winding arrangement initially on a winding plane. The arrangement also has a spool magazine for holding a plurality of spools of thread, located one behind the other on an axis running orthogonal to the winding plane. Also included is a feed arrangement positioned circumferentially on the winding arrangement and intersecting the winding plane. The feed arrangement transports thread, wound in a sheet, perpendicular to the winding plane by an amount corresponding to wind growth. Thus a thread sheet formed as an endless sheet band in a direction transverse to the winding direction can be cut open after completion of a thread warp.

The invention may be practiced in the following manner: The spools of a spooling machine are mounted one behind the other on an axis running orthogonal to the winding plane. In such a construction of the short warp shearing machine, there is obtained a simple compact and robust arrangement which can be readily utilized and supervised. The individual threads can be pulled off at the same time from spools set one behind the other without there being any collision between the individual threads so that the threads would not get twisted together. The winding plane is thus defined by the last wound-up winding.

In one working example, it is provided that a plurality of thread guides for a plurality of spools are provided on one common carrier. This common carrier, for example, a star-shaped carrier, has the same singular separation between the various thread guides and corresponds to the number of spools on the spool magazine. It is therefore not necessary to provide each spool with a separate thread guide.

In accordance with the procedure, it is provided in an advantageous manner that at the same time, several individual threads can be pulled off from spools arranged one behind the other on a common axis, whereby the thread guide means provided to each spool works synchronously with the thread laying means in the take-up arrangement.

Also, a spool stand can be moved in the direction of the spool magazine. In this manner, the angle between a thread guide and the dog on which the individual threads run can be adjusted in accordance with the requirements of space, so that as little friction as possible will occur. In order to facilitate this, the shaft can be telescoped into the drum itself.

BRIEF DESCRIPTION OF THE DRAWINGS

The present invention may be exemplified by the following figures illustrating presently preferred, but nonetheless illustrative embodiments, wherein.

DETAILED DESCRIPTION OF THE PREFERRED EMBODIMENTS

Figure 1:
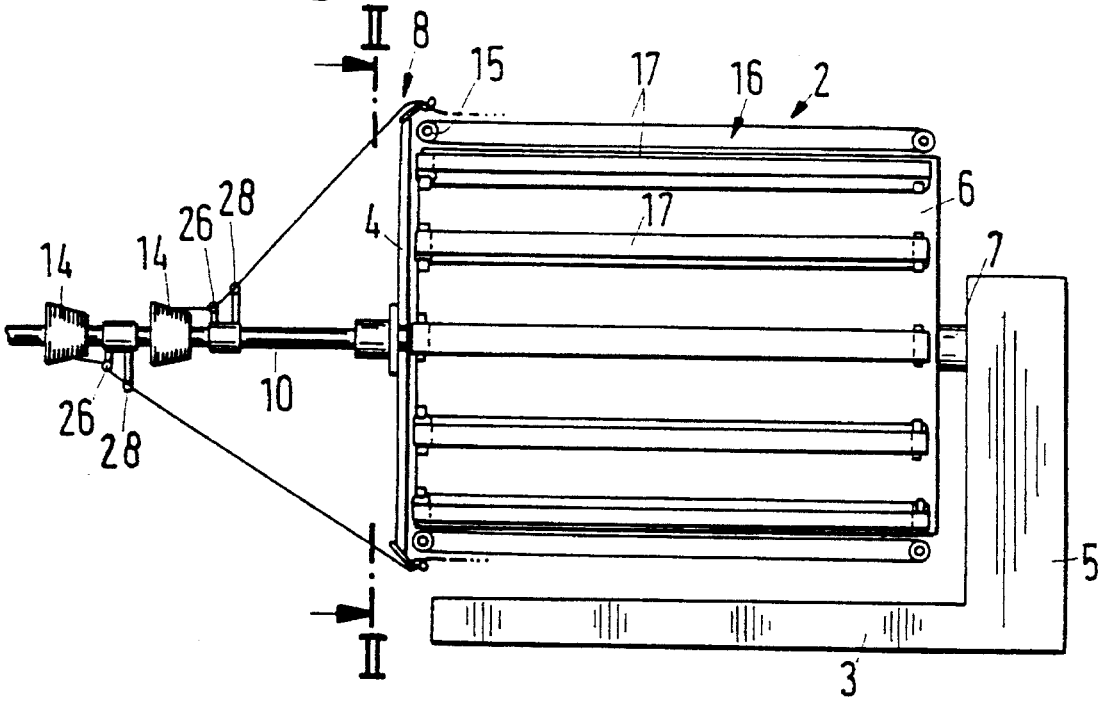
FIG. 1 is a side elevational view of an arrangement in accordance with the principles of the present invention.
Figure 2:
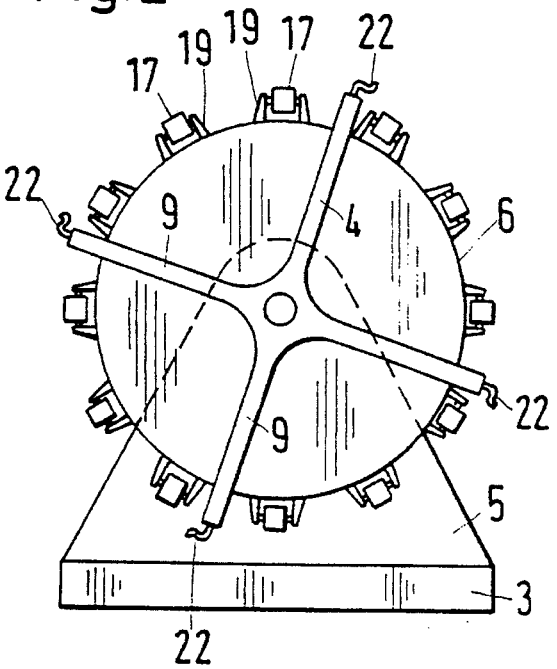
FIG. 2 is a front elevational view of the arrangement for the production of short warps taken along the line II—II of FIG. 1.

Referring to FIGS. 1 and 2, the illustrated arrangement can produce short warps, particularly for weaving patterns in colored weaving. A drum means (2) supported on drum axis (7) is rotatable and can be braked by a suitable stopping means (not shown). The wind-up arrangement (2) suitably comprises a drum (6) whose drum axis (7) is coaxial with the beam (1).

The free end of the axis or shaft (10) can be carried in a spool stand (3). The arrangement comprises a stand means (3) on which a drum (6) of appropriate length is mounted on a drum axis (7). Drum (6) is borne by side piece (5) of spool stand (3). The shaft beam (1) is then carried at both ends wherein a higher level of stability is obtained. A drive motor (not shown) may, if desired, be located in or proximal to the spool stand.

A thread laying means (4) having a rotor with four arms (9) is rotatably mounted on drum axis (7). The thread layer (4) may be shaped as a ring, a disk, or may be a star-shaped arrangement, which is affixed in a co-rotating manner with the beam (10). At the periphery of arms (9) are a number of dogs (corresponding with the number of spools), which dogs distribute the threads taken from the spools in an evenly divided manner.

Each arm (9) of thread laying means (4) carries a dog (22) around the circumferential contour of the drum (6), by means of which the individual threads (1) are wound up on winding arrangement (2) and forwarded on the drum (6) by the feed arrangement (16). The thread layer (4) is mounted on one of the faces (8) of the drum and rotates with dogs (22) around the circumference of the drum, wherein the feed arrangement (16) transports the wound-up thread sheet perpendicular to the wind plane formed by the last wind. This means that the wound up thread sheet parallel to the drum axis (7) is continually transported away from the thread layer (4).

The drive for the displacement movement of the forwarding arrangement (16) can, if desired, be taken off from the rotational movement of the thread layer (4). The feed arrangement (16) comprises feed bands (17) lying parallel to the drum axis (7), and which run endlessly on two turning toilers (15) mounted on the drum circumference of drum (6). The feed bands (17) may also be driven by one motor per pair of rollers (15). The feed bands (17), for each thread orbit, move forward by a predetermined forwarding path, which is determined by the thread diameter. The thread laying means (4) is provided with four dogs (22) and can wind up four individual threads from different spools (14) at the same time. The feed of the feed arrangement (16) is so set that the individual threads are taken up in sequence next to each other in a single layer.

When the threads required for a particular pattern are warped in this manner, the thread sheet obtained as an endless thread band can be severed in the transverse direction in order to obtain the desired pattern warp.

The dogs (22) on arms (9) of the thread layers (4) are displaced by 90° with respect to each other. Four individual threads are pulled from a spool magazine (12) which, in the illustrated example of FIG. 3, comprises four spools (14) which are rotatably mounted on shaft beam (10). One end of each thread is secured to the feed band (17) with glue, adhesive tape or a clamp, whereby its motion pulls the threads from the spools. The shaft beam (10) is connected with thread laying means (4) so as to rotate with it at the same frequency. The beam (10) runs coaxially to the drum axis (7) but can rotate independently thereof.

The provision of a total of four spools on an axis formed by beam (10) prevents the collision between the individual threads (1) so that the thread laying means (4) in the illustrated example can wind four individual threads onto the feed arrangement (16) at the same time. The number of spools (14) is not limited to four. The thread layer (4) would have to be provided with an appropriate number of dogs (22) which, suitably, subtend the same angle to each other.

Figure 3:
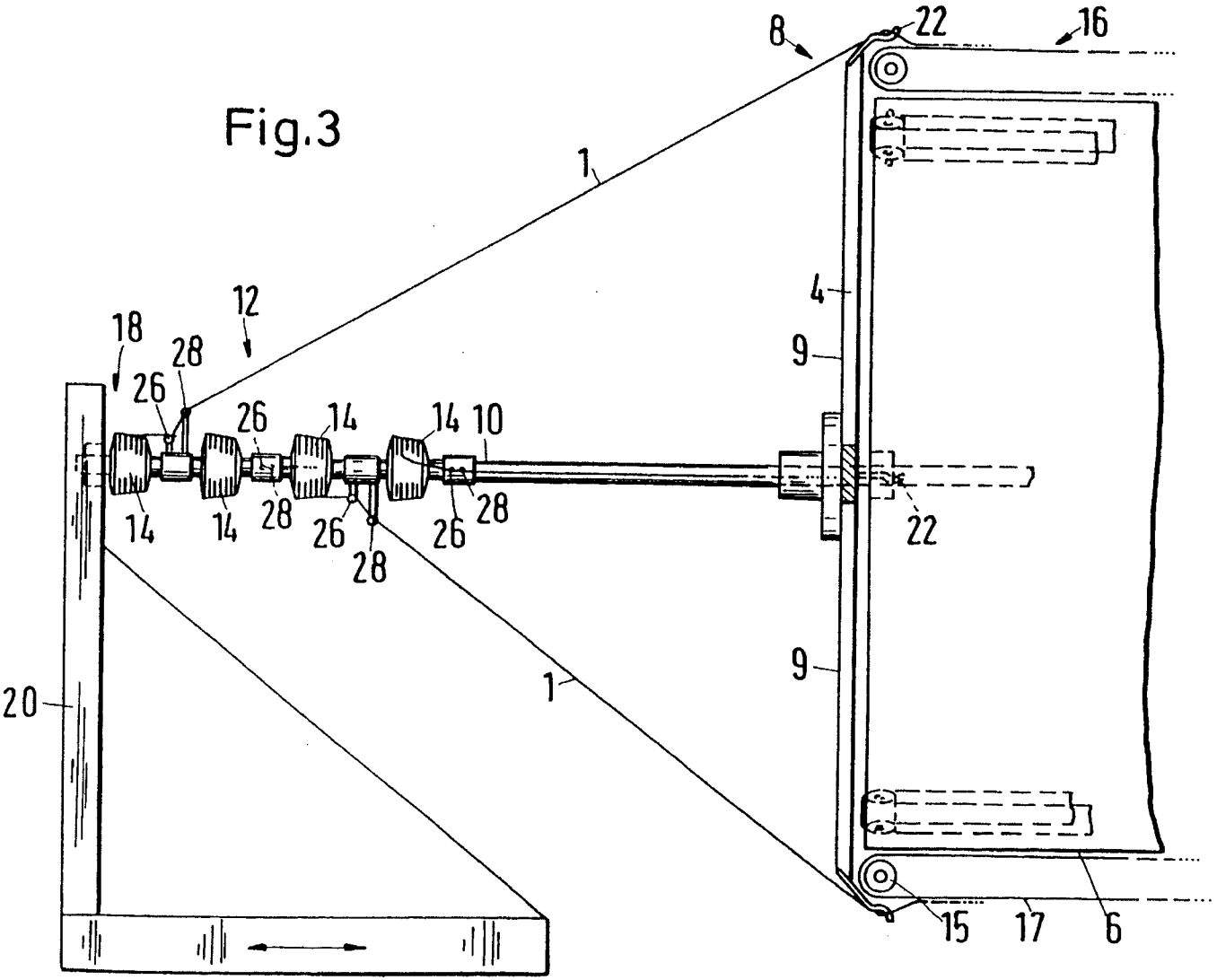
FIG. 3 is a side elevational view detailing the spool magazine.

Referring to FIG. 3, each spool (14) is provided with a thread guide (26) and a thread brake (28) which rotate with the same frequency as shaft (10) and thus ensure that no collision will occur between the four individual threads (1).

The free end (18) of the shaft (10) can be borne in a spool stand (20) whereby the mounting of the spool magazine (12) has a higher stability.

The spool stand (20) is displaceable in the direction of shaft (10) wherein the provision angle of the individual threads can be altered. One can also provide that the end of shaft (10) directed to drum (6) is actually telescopable into drum (6).

In operation in a preferred working example of FIGS. 1–3, it is provided that the axis comprises a rotating shaft beam (10), driven by a motor, and rotatably connected to the thread laying means (4). Thread laying means (4) carries with it the thread guides (28) of each spool (14) in a rotatably fixed manner. The shaft beam (10) makes it possible to avoid the separate driving of the thread guides wherein the synchronization with the thread layers (4) is automatically obtained.

Accordingly, the spools (14) of the spool magazine (12) are located one behind the other on an axis running orthogonal to the winding plane. Suitably, each spool (14) of the spool magazine (16) is synchronously provided to the thread laying means (4) of the rotating thread guide (26). The axis is formed by a rotating beam (10) non-rotatably fixed to the thread carrier (4), which takes up the thread guide (26) in a non-rotatable manner. Suitably the free end (18) of the axis or beam (10) is borne by a spool stand (20) which may be is displaceable in the direction of the axis. In one embodiment the beam (10) is telescopable into the drum (6).

Short warps may be used to produced woven patterns. In such short warps, adjacent threads (1) may have different colors and may be placed in a single layer on a winding arrangement. The threads are laid in succession by a thread laying means (4) at the end face (8). particular for woven patterns in which threads (1) of different colors are placed on a winding arrangement next to each other in single layers and sequentially which respect to each other, by means of a thread laying means (4) on the one face side (8). The thread laying means (4) rotates around the circumferential contour of the winding arrangement (12) and at least one thread (1) is pulled from a spool (14) in a spool magazine (12) on a forwarding arrangement (16) located on the circumference of the winding arrangement (in a winding plane). Forwarding arrangement (16) transports the wound up thread sheet perpendicular to the winding plane corresponding to the wind growth. The thread sheet obtained as an endless sheet band in the direction transverse to the winding direction can be cut open after completion of the thread warp.

Preferably, a plurality of individual threads (1) are pulled off a plurality of spools mounted one behind the other on a common axis. Each spool (14) has a thread guide system moving synchronously with the thread laying on the take-up arrangement (2).

Figure 4:
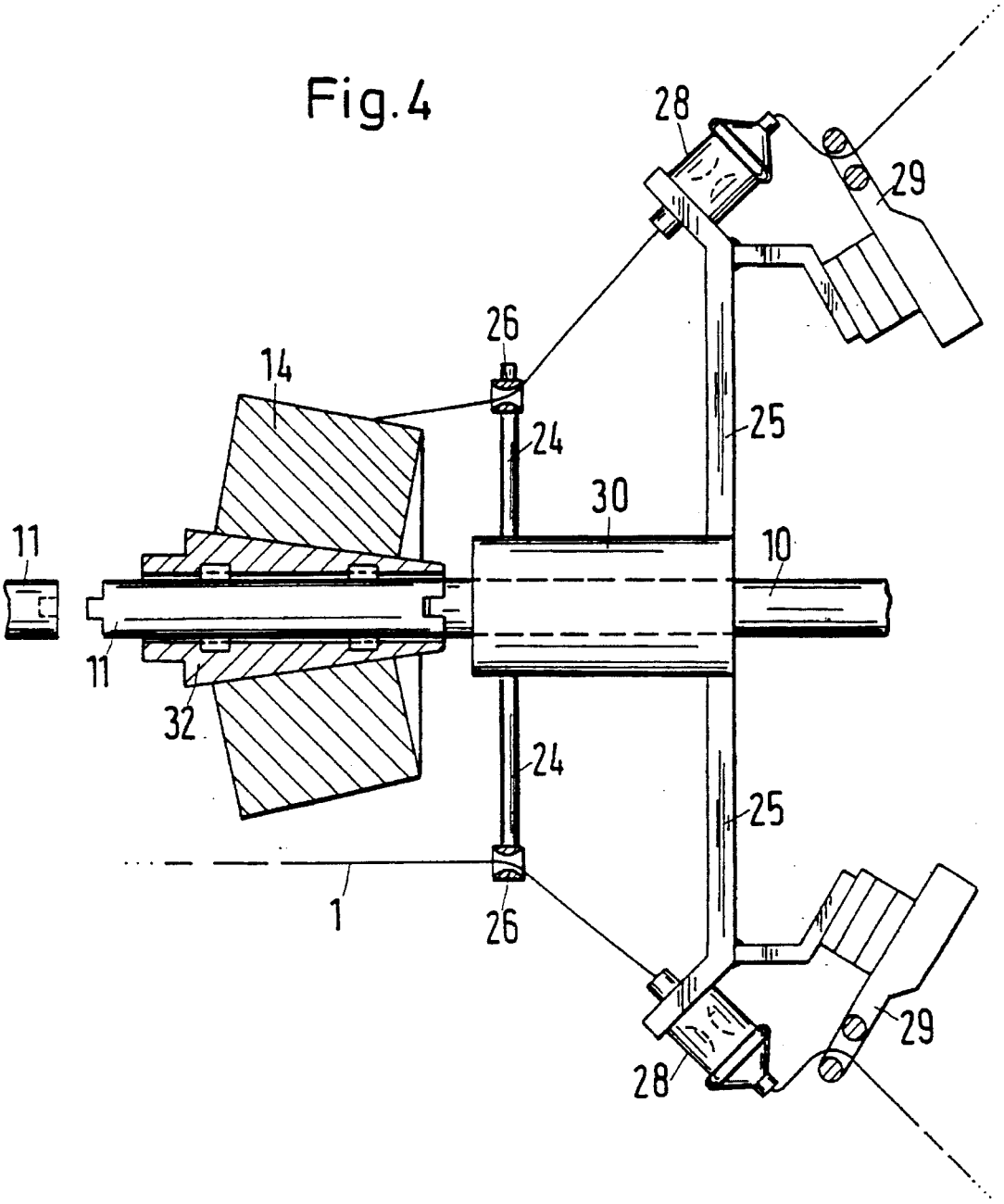
FIG. 4 is an alternate spool take-up of the spooling magazine with thread guide, thread brake and thread watcher.

FIG. 4 illustrates a variant of the thread provision with a carrier (30) which, with the assistance of rotating arms (24)

carries a plurality of thread guides (26) for the appropriate number of spools (14). The arms (24) rotate with the frequency of shaft (10) and have a different length. In the illustrated example of FIG. 4 carrier (30) is provided for two spools. As may be seen from the drawing, arms (24) are displaced 180° with respect to each other, wherein the lower arm is longer so that the threads of the not illustrated second spool (13) may be led in a collision-free manner to the lower thread guide (26). Of course the carrier (30) could have a larger number of rotating arms (24) corresponding to the number of spools (14) in spooling magazine (12).

As before the previously mentioned winding arrangement (2) employs a drum whose drum axis is coaxial with a beam (10). The thread layer (4) may be a ring, disk, or a star-shaped arrangement which is affixed in a co-rotating manner with the shaft (10). At the circumference of the thread layer (4), there are provided a number of dogs (22) corresponding with the number of spools (14) which distribute the threads (1) taken from the spools (14) in an evenly divided manner. The thread guides (26) for a plurality of spools (12) may be provided to a common carrier (30).

For example, in the simultaneous winding of four individual threads from four spools set one behind another, the dogs are advantageously set on the thread guide with a mutual separation of 90° so that the individual threads are timely wound up in sequential manner, and that the forwarding arrangement can provide for an appropriate sidewards displacement of the wound-up threads.

Every spool of the spooling machine is arranged to run synchronously with the thread layer of the rotating thread guide (26). The thread guide (26) for each spool turns with the same frequency as the thread layer (4) and thus clearly avoids the collision between individual threads. It is advantageous to combine the thread guide with a thread brake and a thread watcher.

The carrier (30) further comprises rotating arms (25) which carry a thread brake (28) and a thread control (28) and a thread controller (29). The spool (14) is placed on a take-up cone (32) which is rotatably supported by the shaft (10).

As illustrated in FIG. 4, the shaft (10) can be divided up so that a plurality of spools (14) can be located one behind the other, for example eight spools with individual colors may be used wherein then, for example only four spools would be needed to the wind-up arrangement.

It is to be anticipated that individual shaft segments (11) are provided with rapid coupling to enable rotatable coupling between them. In such a manner, different spools (14) could be readily exchanged without problems.

Obviously, many modifications and variations of the present invention are possible in light of the above teachings. It is therefore to be understood that within the scope of the appended claims, the invention may be practiced otherwise than as specifically described.

We claim:

1. Arrangement for the production of short warps for woven patterns employing threads of different colors, comprising:

a winding arrangement adapted to receive said threads of different colors wound sequentially next to each other in a single layer;

a thread laying means mounted adjacent to an end face of said winding arrangement for orbiting said winding arrangement circumferentially at said end face for laying said threads in said single layer around said winding arrangement initially at a winding plane;

a spool magazine for holding a plurality of spools of thread located one behind the other on an axis running orthogonal to the winding plane; and a feed arrangement positioned circumferentially on said winding arrangement and intersecting said winding plane, said feed arrangement transporting thread, wound in a sheet, perpendicular to the winding plane by an amount corresponding to growth of said single layer in a direction away from said winding plane, so that a thread sheet formed as an endless sheet band in a direction transverse to the winding direction can be cut open after completion of a thread warp.

2. Arrangement in accordance with claim 1 comprising:

a plurality of rotating thread guides mounted proximate to corresponding ones of the spools of the spool magazine to direct thread synchronously to the thread laying means.

3. Arrangement in accordance with claim 2 comprising:

a rotating beam non-rotatably secured to the thread laying means and the thread guide to cause them to rotate together with said beam.

4. Arrangement in accordance with claim 3 wherein said winding arrangement comprises:

a drum having a drum axis coaxial with the beam.

5. Arrangement in accordance with any one of the claims 1 through 4, comprising:

a spool stand for supporting an end of said beam distal from said winding arrangement.

6. Arrangement according to claim 4 wherein the thread laying means comprises:

a rotor affixed to said beam to rotate therewith; and a plurality of dogs mounted circumferentially on said rotor, said dogs being associated with corresponding ones of said spools for distributing threads taken from the spools in an evenly divided manner.

7. Arrangement in accordance with claim 5 wherein the spool stand has means for axially displacing said spool stand with respect to said winding arrangement.

8. Arrangement in accordance with claim 6 wherein the beam is telescopically mounted in the drum.

9. Arrangement in accordance with claim 3, wherein said wind arrangement comprises:

a drum having a drum axis coaxial with the beam, the beam being telescopically mounted at the drum.

10. Arrangement in accordance with any one of the claims 2, 3, 4, 6, 7, or 8, comprising:

a common carrier supporting more than one of said thread guides for guiding threads from more than one of said spools.

11. Arrangement according to claim 3 wherein the thread laying means comprises:

a rotor affixed to said beam to rotate therewith; and a plurality of dogs mounted circumferentially on said rotor, said dogs being associated with corresponding ones of said spools for distributing threads taken from the spools in an evenly divided manner.

12. Arrangement for the production of short warps, in particular for woven patterns employing threads of different colors, comprising:

a winding arrangement for receiving threads next to each other in a single layer and sequentially with respect to each other;

a thread laying means positioned adjacent to an end face of said winding arrangement, for orbiting around the winding arrangement to lay thread circumferentially in said single layer, threads being initially laid by said thread laying means along a winding plane;

a spool magazine for holding a plurality of spools one behind the other on a common axis running orthogonal to the winding plane, for simultaneously supplying a plurality of individual threads from a plurality of spools mounted one behind the other on a common axis;

a thread guide system having means for moving synchronously with the thread laying on the winding arrangement provided by the thread laying means; and a forwarding arrangement positioned circumferentially about the winding arrangement to intersect the winding plane, for transporting a thread sheet winding in a direction perpendicular to the winding plane at a rate corresponding to growth of said single layer in a direction away from said winding plane, so that a thread sheet obtained as an endless sheet band in a direction transverse to the winding direction can be cut open after completion of a thread warp.

13. Arrangement for the production of short warps for woven patterns employing threads of different colors, comprising:

a winding arrangement adapted to receive said threads of different colors wound sequentially next to each other in a single layer;

a thread laying means mounted adjacent to an end face of said winding arrangement for orbiting said winding arrangement circumferentially at said end face for laying said threads in said single layer around said winding arrangement initially at a winding plane;

a spool magazine for holding a plurality of spools of thread located one behind the other on an axis running orthogonal to the winding plane;

a plurality of rotating thread guides mounted proximate to corresponding ones of the spools of the spool magazine to direct thread synchronously to the thread laying means; and a feed arrangement positioned circumferentially on said winding arrangement and intersecting said winding plane, said feed arrangement transporting thread, wound in a sheet, perpendicular to the winding plane by an amount corresponding to growth of said single layer in a direction away from said winding plane, so that a thread sheet formed as an endless sheet band in a direction transverse to the winding direction can be cut open after completion of a thread warp.

* * * * *